United States Patent [19]

Hines

[11] Patent Number: 5,002,280

[45] Date of Patent: Mar. 26, 1991

[54] ADJUSTABLE AND FOLDING PUTTING GREEN

[76] Inventor: Burl D. Hines, P.O. Box 560 Highway 157 N., Plain Dealing, La. 71064

[21] Appl. No.: 502,780

[22] Filed: Apr. 2, 1990

[51] Int. Cl.[5] ..... A63B 67/02

[52] U.S. Cl. ..... 273/176 FB; 273/176 H; 273/DIG. 31; 273/178 B; 273/176 J; 273/DIG. 13; 206/315.1

[58] Field of Search ..... 273/176 R, 176 E-176 J, 273/195 R, 195 B, 87 C, 87 E, 118 R, DIG. 31, DIG. 13, 178 R, 178 A, 178 B; 206/315.1

[56] References Cited

U.S. PATENT DOCUMENTS

| | | | |
|---|---|---|---|
| 1,582,183 | 4/1926 | Maurer | 273/176 H |
| 2,384,723 | 9/1945 | Brodzik et al. | 273/176 F |
| 3,170,694 | 2/1965 | Dolce | 273/176 H |
| 3,601,407 | 12/1968 | Lorrance | 273/176 H |
| 3,727,917 | 4/1973 | MacLean | 273/176 H |
| 3,831,949 | 8/1974 | Henning | 273/176 H |
| 3,861,524 | 1/1975 | Coleman | 273/176 H X |
| 3,892,412 | 7/1975 | Koo | 273/176 H |
| 3,936,055 | 2/1976 | Scott | 273/176 H |
| 3,944,232 | 3/1976 | Tierney | 273/176 H X |
| 3,990,573 | 11/1976 | Cross | 273/176 FB X |
| 4,092,027 | 5/1978 | Carter | 273/195 R |
| 4,211,417 | 7/1980 | Brown | 273/176 H |
| 4,222,568 | 9/1980 | Russo | 273/176 H |
| 4,240,637 | 12/1980 | Cross et al. | 273/176 H |
| 4,596,391 | 6/1986 | Carolan | 273/176 FB X |
| 4,611,809 | 9/1986 | Gettelfinger | 273/176 X |

FOREIGN PATENT DOCUMENTS

| | | | |
|---|---|---|---|
| 358362 | 10/1931 | United Kingdom | 273/176 F |
| 2121297 | 12/1983 | United Kingdom | 273/176 R |

*Primary Examiner*—Edward M. Coven
*Assistant Examiner*—Sebastiano Passaniti
*Attorney, Agent, or Firm*—John M. Harrison

[57] ABSTRACT

An adjustable and folding putting green which includes an enclosure for receiving a foldable playing surface characterized by a flexible material resembling an artificial grass-like ground covering sold under the trademark "Astroturf" mounted on a folding support carried by a folding frame, which frame and support are extendible from the enclosure for playing purposes and foldable inside the enclosure for storage. The frame is provided with multiple pivoting adjusting levers which can be independently attached to the support and manipulated to tilt the playing surface in a desired configuration and contour to simulate varying terrain and provide a surface contouring effect while putting. A player support is hinged to one end of the folding frame for supporting a golfer and the opposite end of the playing folding frame is provided with a rotating cup member having cups located in varying positions thereon, to present different targets for the putter.

16 Claims, 2 Drawing Sheets

ADJUSTABLE AND FOLDING PUTTING GREEN

BACKGROUND OF THE INVENTION

1. Field of the Invention

This invention relates to artificial putting greens and more particularly, to an adjustable and folding putting green which is characterized by a playing surface frame and a flexible playing surface, both of which are adapted for folding into an enclosure for storage and extension from the enclosure in playing configuration. The playing surface frame is further provided with spaced adjusting levers which are selectively attached to the playing surface and may be manipulated individually or in concert to vary the topography, contour or terrain of the playing surface and simulate actual putting conditions on a golf course. A rotating cup member is provided at the target end of the playing surface frame and includes cups located in varying positions to create a variety of putting conditions. A player support is hinged to the opposite end of the playing surface frame to facilitate a support or stand for the putter.

The game of golf has long enjoyed great popularity among people of all ages. An integral part of the game of golf is putting and extensive practice is required in order to gain proficiency in the art of putting on a golf course. Accordingly, it has become customary to practice putting indoors on a flexible material resembling an artificial grass-like ground covering sold under the trademark "Astroturf" or on carpet in an office or home, as well as on the golf course. Unfortunately, these artificial surfaces seldom accurately duplicate the actual conditions found on a golf course, since the topography and contour of the greens may vary widely on any golf course.

2. Description of the Prior Art

Various devices are known in the art for simulating putting greens in order to practice putting. An early "Putting Green" is detailed in U.S. Pat. No. 2,384,723, dated Sept. 11, 1945, to W.F. Brodzik, et al. The putting green is constructed of a pile fabric wherein the piles are characterized by tufts of angora, mohair or other natural or synthetic fiber having substantially the same characteristics of resilience and stiffness. A "Variable-Surface Game Table" is detailed in U.S. Pat. No. 3,170,694, dated Feb. 23, 1965, to J.P. Dolce. The table includes a substantially horizontal playing field for supporting rolling spherical elements and is characterized by selectively actuating an adjusting mechanism to variably raise and lower the surface areas of the field and create a surface contouring effect. U.S. Pat. No. 3,727,917, dated Apr. 17, 1973, to George D. MacLean, details a "Variable Contour Golf Putting Device". The device includes multiple hingedly interconnected base sections extendible to form an elongated golf putting surface, along with a flexible, continuous associated surface covering. The apparatus is adjustable for varying putting surface contours and is collapsible to an easily portable package by interconnecting adjoining base sections with hinges located alternately at the top and bottom surfaces thereof. Also provided are multiple pegs and blocks for supporting adjacent base sections at different selected elevations. A "Variable Contour Miniature Golf Surface" is detailed in U.S. Pat. No. 3,831,949, dated Aug. 27, 1974, to Georges Henning. The golf device is characterized by a foldable unit adapted to play mini-golf by putting thereon and arranged to play a multi-hole game therewith by arranging the same into a desired number of different configurations. A variable mini-golf unit includes multiple floor sections interconnected by multiple connecting ramp sections, each section being pivoted end-to-end and having lateral side walls to form a continuous floor path and having legs pivoted to each floor section to selectively elevate the latter relative to other floor sections. Angularly adjustable deflection bars are pivoted onto the floor sections and the floor path to vary the difficulty of putting a ball into a hole, the sections being of progressively increasing width to facilitate folding one within the lateral confines of the side wall of the other, to form a compact package. A "Portable Golf Game" is detailed in U.S. Pat. No. 4,596,391, dated June 24, 1986, to Leo P. Carolan, Jr. The golf game includes a planar playing surface formed of multiple segment portions, one end of the playing surface having a location thereon for placement of a cup for receiving golf balls. Walls extend substantially normal to the playing surface located partly around the edge thereof, with predetermined locations indicated on portions of the playing surface and at least one obstacle member for placement on the playing surface at the predetermined location and increasing the difficulty of play. At least two of the playing surface segment portions are selectively joined to form a container for containment of the other segment portions and the obstacle members.

It is an object of this invention to provide an adjustable and folding putting green which is characterized by a playing surface frame assembled in hinged segments and adapted for folding in stored configuration and extension to present an adjustable practice putting surface in functional configuration.

Another object of the invention is to provide an adjustable and folding putting green which includes an enclosure, a playing surface frame characterized by hinged segments provided with a playing surface, with multiple adjusting levers mounted in the playing surface frame for selective attachment to the playing surface and adjusting the contour of the playing surface to simulate actual putting conditions.

Still another object of this invention is to provide an adjustable and folding putting green for practicing putting in the game of golf, which putting green is characterized by an enclosure, at least two playing surface frame segments hingedly connected for folding in the enclosure in stored configuration and extension from the enclosure in playing configuration, a playing surface adjustably mounted on the playing surface frame segments and multiple adjusting levers pivotally mounted in the playing surface frame in alternating, spaced relationship, and adapted for selective attachment to the playing surface and adjusting the contour of the playing surface and simulating actual putting conditions on a golf course.

Another object of the invention is to provide an adjustable and folding putting green which is characterized by an enclosure, a hinged playing surface frame provided with an adjustable playing surface, which playing surface and playing surface frame are hingedly foldable into the enclosure in stored configuration and extendible from the enclosure in playing configuration, multiple levers pivotally and adjustably provided in spaced, alternating pivoting relationship in the playing surface frame for selectively engaging the playing surface and adjusting the contour of the playing surface and a rotating cup member located inside the enclosure for adjusting the cup position in the adjustable and folding putting green.

SUMMARY OF THE INVENTION

These and other objects of the invention are provided in a new and improved adjustable and folding putting green which is portable, easily deployed and used and includes an enclosure adapted to receive a hinged and adjustable playing surface carried by a playing surface frame in stored configuration, wherein the hinged playing surface frame and associated playing surface can be extended from the enclosure in playing configuration, multiple adjusting bars pivotally attached to the playing surface frame in alternating spaced relationship, for selectively engaging the playing surface and adjusting the surface contour of the playing surface, a rotating cup member located inside the enclosure at the target end of the playing surface for varying the location of the cup and a hinged player support provided at the opposite end of the playing surface for supporting a golfer in putting stance.

BRIEF DESCRIPTION OF THE DRAWINGS

The invention will be better understood by reference to the accompanying drawings, wherein.

DESCRIPTION OF THE PREFERRED EMBODIMENTS

Figures 1, 2, 3, 4, 5, 6, 7:
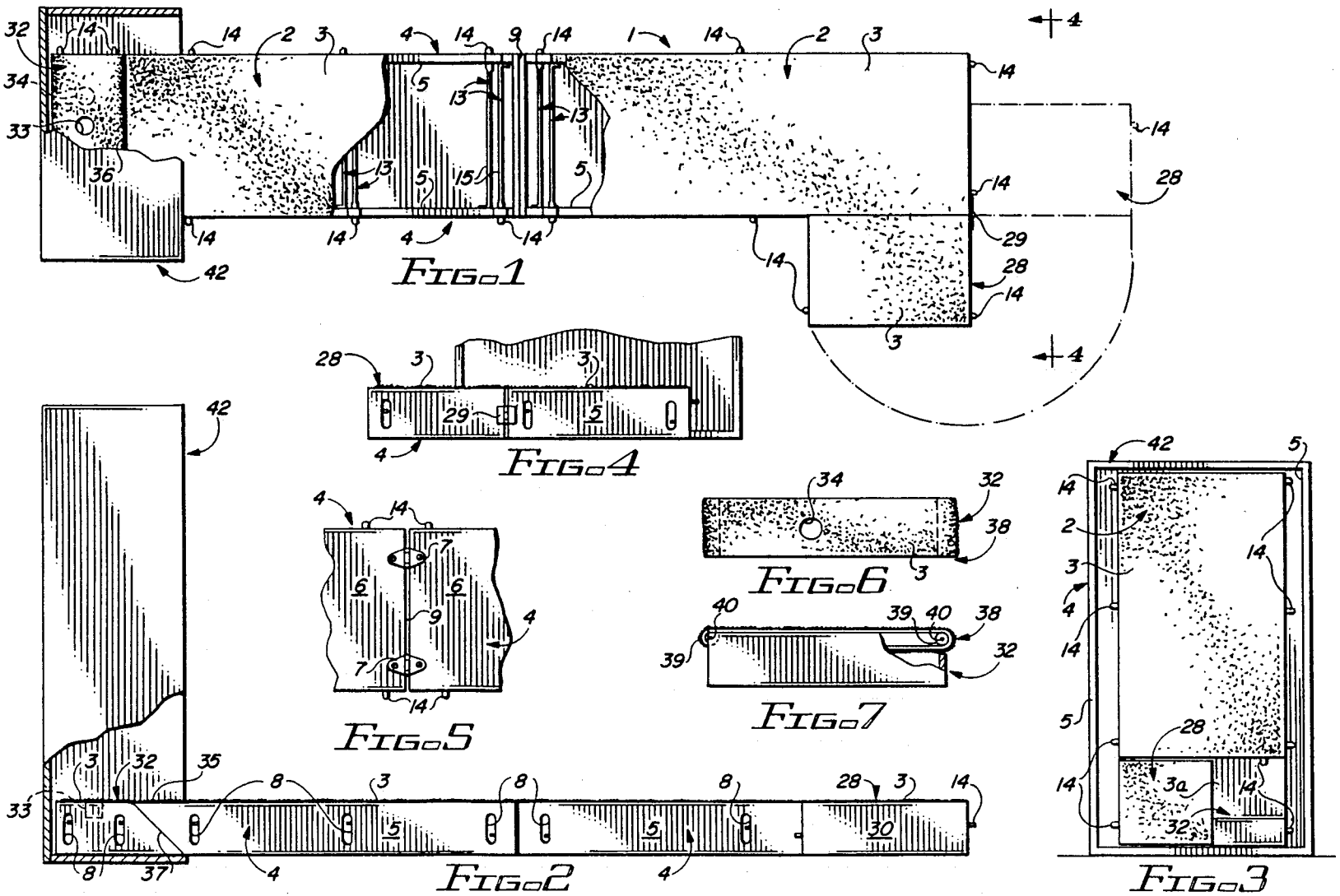
FIG. 1 is a top view, partially in section, of a preferred embodiment of the adjustable and folding putting green of this invention disposed in playing configuration.
FIG. 2 is a side view, partially in section, of the adjustable and folding putting green illustrated in FIG. 1.
FIG. 3 is a front end view of the adjustable and folding putting green in folded and stored configuration.
FIG. 4 is a front end view, partially in section, of the adjustable and folding green illustrated in FIGS. 1 and 2.
FIG. 5 is a bottom view of hinged elements of the playing surface frame component of the adjustable and folding putting green.
FIG. 6 is a top view of a cup belt element of a rotating cup member in the adjustable and folding putting green illustrated in FIGS. 1 and 2.
FIG. 7 is a side view of the rotating cup member which receives the cup belt element illustrated in FIG. 6.
Figures 8, 9, 10, 11, 12, 13, 14:
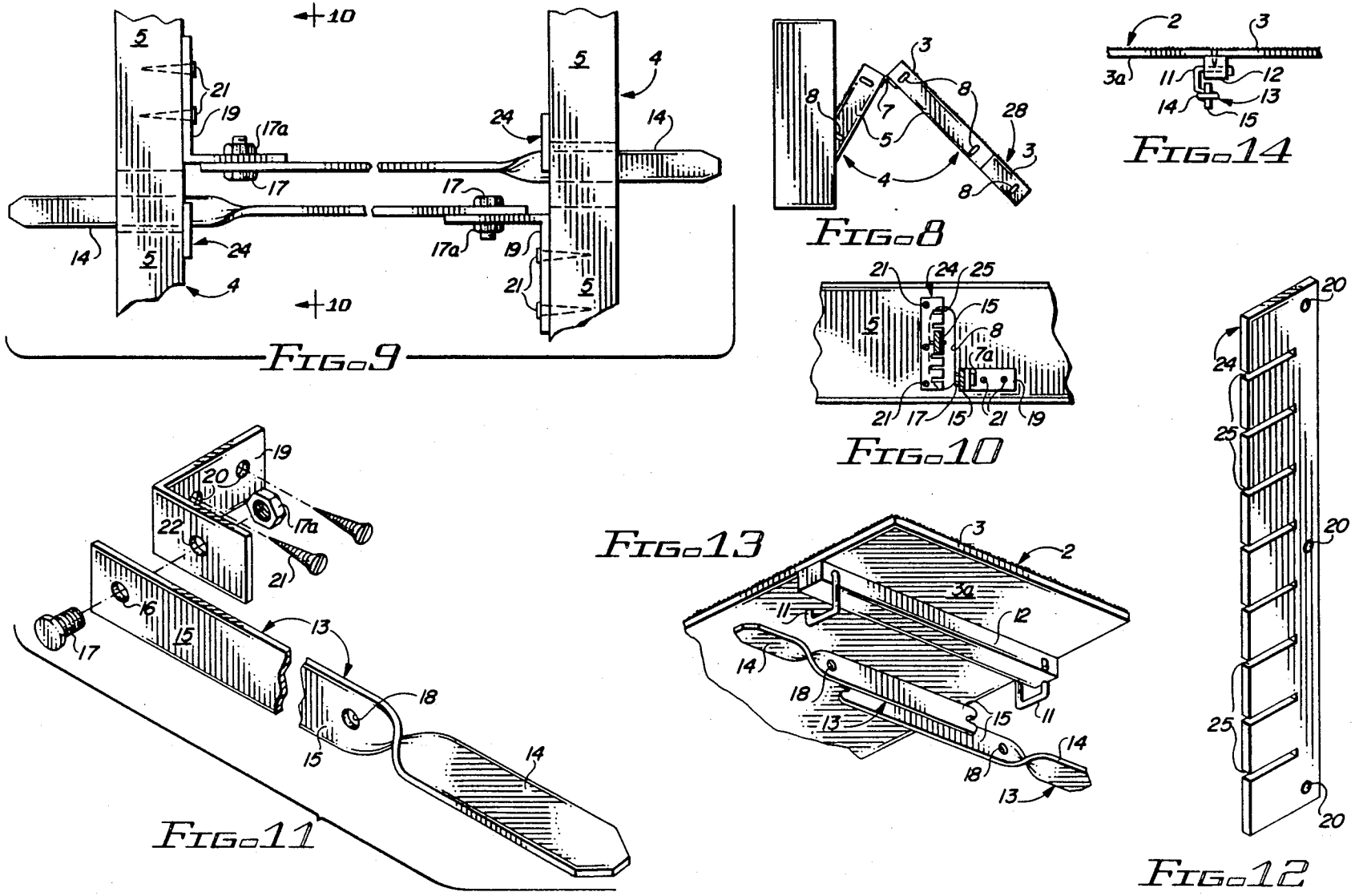
FIG. 8 is a side view of the adjustable and folding putting green illustrated in FIG. 2 in partially folded configuration.
FIG. 9 is a top view, partially in section, of a pair of adjusting levers which are pivotally and adjustably attached to opposite sides of the playing surface frame for selectively varying the contour of the playing surface adjustably mounted in the playing surface frame.
FIG. 10 is a side view, partially in section, of a typical adjusting plate for receiving the free end of an adjusting lever and varying the contour of the playing surface.
FIG. 11 is an exploded view, partially in section, of a typical pivoting mounting configuration for the adjusting levers.
FIG. 12 is a perspective view of the adjusting plate illustrated in FIG. 10.
FIG. 13 is a perspective view, partially in section, of the underside of the playing surface, more particularly illustrating a preferred technique for selectively attaching the adjusting levers to the playing surface for varying the contour thereof.
FIG. 14 is an end view, partially in section, of the playing surface and engaged adjusting lever illustrated in FIG. 13.

Referring initially to FIGS. 1–5 and 13 of the drawings, the adjusting and folding putting green of this invention is generally illustrated by reference numeral 1. The adjustable and folding putting green 1 is characterized by a playing surface 2, having a flexible material resembling an artificial grass-like covering sold under the trademark "Astroturf", mounted on a resilient "Astroturf" support 3*a*, as illustrated in FIG. 13. The "Astroturf" support 3*a* may be constructed of a thin sheet of plywood, plastic or other flexible or resilient material, the topography or contour of which may be changed by mechanical adjustment, as hereinafter further described. The playing surface 2 is seated in a playing surface frame 4, between parallel side frame members 5, fitted with bottom frame members 6, as illustrated in FIG. 5. As further illustrated in FIG. 5, the playing surface frame 4 is characterized by two segments or sections of side frame members 5 and bottom frame members 6, the latter of which are joined at a bottom frame member margin 9, illustrated in FIGS. 2 and 5, by bottom frame member hinges 7. Corresponding hinges (not illustrated) are provided in the "Astroturf" support 3*a* at the "Astroturf" support margin 10, illustrated in FIG. 2. Adjusting slots 8 are provided in the side frame members 5 in spaced relationship, as illustrated in FIGS. 2 and 4, for a purpose which will be further hereinafter described.

Referring now to FIGS. 1, 9–11 and 13, multiple adjusting levers 13 are located beneath the playing surface 2 in the playing surface frame 4 between the side frame members 5. One end of the lever shaft 15 of each of the adjusting levers 13 is pivotally attached to an L-shaped pivot bracket 19 by means of a pivot bolt 17, which extends through the registering pivot bolt hole 16, provided in the lever shaft 15 and the bracket bolt hole 22, in one leg of the pivot bracket 19, to receive a nut 17*a*. The other leg of the pivot bracket 19 is further provided with spaced screw openings 20, for receiving the wood screws 21 and mounting the corresponding leg of the pivot brackets 19 to one of the side frame members 5. Accordingly, as illustrated in FIG. 11, the lever shaft 15 of each of the adjusting levers 13 is pivotally secured to a corresponding pivot bracket 19. Furthermore, the lever handle 14, twisted at the point of extension from the lever shaft 15 to lie in a plane which is perpendicular to the plane of the lever shaft 15, is adapted to engage a selected one of the plate slots 25 in a corresponding adjusting plate 24, attached to the opposite side frame member 5, as illustrated in FIGS. 9 and 10. The "Astroturf" support 3*a* of the playing surface 2 is fitted with a hook mount block 12 at each of the adjusting levers 13 and a pair of oppositely-disposed, L-shaped adjusting lever hooks 11 project downwardly and extend in opposite directions from each hook mount block 12, as illustrated in FIG. 13. Since the playing surface 2 rests upon the lever shafts 15 of each of the adjusting levers 13 between the side frame members 5, the contour of the playing surface 2 may be adjusted between the side frame members 5 by operation of the respective adjusting levers 13. This adjustment is facilitated by engaging the lever handle 14 of the respective adjusting levers 13 with the corresponding adjusting lever hook 11, as illustrated in FIG. 14, wherein the adjusting lever hook 11 is inserted through a hook opening 18 provided in the lever shaft 15. Accordingly, movement of the adjusting levers 13 upwardly or downwardly when the lever shaft 15 is attached to the respective lever shaft 15, also moves the playing surface 2 upwardly or downwardly at a selected point along the playing surface frame 4, to create a topographical warp, dip or rise in the playing surface 2.

Referring now to FIGS. 1 and 4 of the drawings, a player support 28 includes spaced support members provided with a top panel (not illustrated) having "Astroturf" 3 on the top surface thereof and is designed for hinged attachment to the extending end of the playing surface frame 4 by means of the support hinges 29. Accordingly, it will be appreciated that the player support 28 can be pivoted into the position illustrated in phantom in FIG. 1 when it is desired to fold the playing surface frame 4 and playing surface 2, along with the player support 28, into the enclosure 42, as hereinafter further described. Meanwhile, the player support 28 can be functionally oriented as illustrated in FIG. 1 to support a putting golfer for putting on the "Astroturf" 3 located on the playing surface 2. It will be further appreciated that the player support 28 may be hinged on the opposite side of the playing support frame 4 from the position illustrated in FIG. 1, in order to accommodate left-handed golfers, as desired.

Referring now to FIGS. 1, 2, 6 and 7 of the drawings, in another preferred embodiment of the invention a rotating cup member 32 is provided on the target end of the playing surface 2, located within the enclosure 42. A center cup 33 and an offset cup 34 (illustrated in phantom) are positioned in a cup belt 38 mounted on the rotating cup member 32. The cup belt 38 is, in turn, mounted on a pair of spaced belt drums 39, connected by a drum shaft 40, to present various cup locations to a player standing on the player support 28 at the opposite end of the playing surface 2. Accordingly, when it is desired to present the offset cup 34 to the putter as a target, the cup belt 38 is manually rotated until the offset cup 34 is positioned in alignment with the center of the playing surface 2, as illustrated in FIG. 1. The cup belt 38 can be similarly rotatably manipulated to present the offset cup 34 in open configuration to the right of center of the playing surface 2, as further illustrated in phantom in FIG. 1. The center cup 33 and offset cup 34 are constructed of a resilient plastic or fabric to facilitate rotation over the belt drums 39 and collecting golf balls (not illustrated).

Referring again to FIGS. 1, 2, 3 and 8 of the drawings and specifically to FIG. 2, a cup member hinge 35 is located at a cup member margin 36 to mount the first element of the playing surface frame 4 to the rotating cup member 32. In a preferred embodiment, this first element of the playing surface frame 4 and the rotating cup member 32 are bevelled at the cup member bevel 37, to facilitate folding of the playing surface frame 4 and the player support 28 into the enclosure 42, as illustrated in FIGS. 3 and 8.

It will be appreciated by those skilled in the art that the adjustable and folding putting green of this invention may be constructed in substantially any length and width, which dimensions are limited only by the size of the enclosure and the room in which the adjustable and folding putting green is to be located. Furthermore, the components of the adjustable and folding putting green 1 can be constructed of wood, plastic, fiberglass or other selected material, as desired, and the playing surface 2 can be fitted with "Astroturf" as described above, or an alternative material which simulates natural grass growing on the greens of a golf course. It will be appreciated that the enclosure 42 may be finished such that it simulates a decorative article of furniture for the office or home and it may be provided with doors or other closure elements (not illustrated) for completely enclosing the playing surface frame and player support therein.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An adjustable and folding putting green comprising a playing surface frame provided with an adjustable playing surface and hinges provided in said playing surface frame for selectively folding said playing surface frame and said playing surface into a folding configuration and extending said playing surface frame and said playing surface into playing configuration; at least one adjusting slot provided in one side of said playing surface frame; at least one elongated lever having one end pivotally attached to the opposite side of said playing surface frame and the opposite end of said lever projecting through said adjusting slot; at least one adjusting plate mounted on said one side of said playing surface frame adjacent to said adjusting slot and plate slots provided in said adjusting plate in vertically spaced relationship for selectively receiving said opposite end of said lever; and hook means carried by said playing surface for receiving said opposite end of said lever and adjusting the contour of said playing surface responsive to manipulation of said opposite end of said lever in said plate slots.

2. The adjustable and folding putting green of claim 1 further comprising rotatable cup means provided in said playing surface frame and at least one cup provided in said rotatable cup means in spaced relationship, said cups selectively located in functional configuration in alignment with said playing surface responsive to rotation of said rotatable cup means.

3. The adjustable and folding putting green of claim 1 further comprising player support means hingedly connected to said playing surface frame for selectively pivoting into alignment with said playing surface frame when said playing surface frame is folded into said folded configuration and outwardly of said playing surface frame when said playing surface frame is extended into said playing configuration.

4. The adjustable and folding putting green of claim 1 further comprising:

(a) rotatable cup means provided in said playing surface frame and at least one cup provided in said rotatable cup means in spaced relationship, said cup selectively located in functional configuration in alignment with said playing surface responsive to rotation of said rotatable cup means; and (b) player support means hingedly connected to said playing surface frame for selectively pivoting into alignment with said playing surface frame when said playing surface frame is folded into said folded configuration and outwardly of said playing surface frame when said playing surface frame is extended into said playing configuration.

5. The adjustable and folding putting green of claim 1 further comprising enclosure means hingedly connected to said playing surface frame for receiving said playing surface frame and said playing surface in said folding configuration.

6. The adjustable and folding putting green of claim 5 further comprising rotatable cup means provided in said playing surface frame and at least one cup provided in said rotatable cup means in spaced relationship, said cup selectively located in functional configuration in alignment with said playing surface responsive to rotation of said rotatable cup means.

7. The adjustable and folding putting green of claim 5 further comprising player support means hingedly connected to said playing surface frame for selectively pivoting into alignment with said playing surface frame when said playing surface frame is folded into said folded configuration and outwardly of said playing surface frame when said playing surface frame is extended into said playing configuration.

8. The adjustable and folding putting green of claim 5 further comprising:

(a) rotatable cup means provided in said playing surface frame and at least one cup provided in said rotatable cup means in spaced relationship, said cup selectively located in functional configuration in alignment with said playing surface responsive to adjustment of said rotatable cup means; and (b) player support means hingedly connected to said playing surface frame for selectively pivoting into alignment with said playing surface frame when said playing surface frame is folded into said folded configuration and outwardly of said playing surface frame when said playing surface frame is extended into said playing configuration.

9. The adjustable and folding putting green of claim 8 wherein said playing surface is covered with an artificial grass covering.

10. An adjustable and folding putting green comprising an enclosure; a playing surface provided with an adjustable playing surface and hinges provided in said playing surface frame for selectively folding said playing surface frame and said playing surface inside said enclosure in folded configuration and extending said playing surface frame and said playing surface from said enclosure in playing configuration; adjusting slots provided in spaced relationship in said playing surface frame and a plurality of elongated levers having one end pivotally attached to the sides of said playing surface frame in spaced, alternating relationship and the opposite end of said levers projecting through said adjusting slots provided in said playing surface frame, respectively; a plurality of adjusting plates mounted on the sides of said playing surface frame in spaced, alternating relationship adjacent to said adjusting slots and plate slots provided in said adjusting plates in vertically spaced relationship, for selectively receiving said opposite end of said levers; and hook means carried by said playing surface in spaced relationship for receiving said opposite end of said levers and adjusting the contour of said playing surface responsive to manipulation of said opposite end of said levers in said plate slots, respectively.

11. The adjustable and folding putting green of claim 10 further comprising rotatable cup means provided in said playing surface frame and at least one cup provided in said rotatable cup means in spaced relationship, said cup selectively located in functional configuration in alignment with said playing surface responsive to rotation of said rotatable cup means.

12. The adjustable and folding putting green of claim 10 further comprising player support means hingedly connected to said playing surface frame for selectively pivoting into alignment with said playing surface frame when said playing surface frame is folded into said folded configuration and outwardly of said playing surface frame when said playing surface frame is extended into said playing configuration.

13. The adjustable and folding putting green of claim 10 further comprising:

(a) rotatable cup means provided in said playing surface frame and at least one cup provided in said rotatable cup means in spaced relationship, said cup selectively located in functional configuration in alignment with said playing surface responsive to rotation of said rotatable cup means; and (b) player support means hingedly connected to said playing surface frame for selectively pivoting into alignment with said playing surface frame when said playing surface frame is folded into said folded configuration and outwardly of said playing surface frame when said playing surface frame is extended into said playing configuration.

14. The adjustable and folding putting green of claim 10 wherein said playing surface is covered with an artificial grass covering.

15. An adjustable and folding putting green comprising an enclosure; a playing surface frame provided with an adjustable playing surface and hinges provided in said playing surface frame and said adjustable playing surface for selectively folding said playing surface frame and said playing surface inside said enclosure in folded configuration and extending said playing surface frame and said playing surface from said enclosure in playing configuration; a rotatable cup member hingedly connected to one end of said playing surface frame and at least one resilient cup provided in said rotatable cup member in spaced relationship, said cup selectively located in functional configuration in alignment with said playing surface responsive to rotation of said rotatable cup member; and a plurality of levers pivotally and adjustably carried by said playing surface frame in alternating pivoting relationship, said levers adapted to engage said playing surface and selectively adjust the contour of said playing surface.

16. The adjustable and folding putting green of claim 15 further comprising a player support hingedly connected to said playing surface frame for selectively pivoting into alignment with said playing surface frame when said playing surface frame is folded into said folded configuration and outwardly of said playing surface frame when said playing surface frame is extended into said playing configuration.

* * * * *